US006117208A

United States Patent [19]

Sharma

[11] Patent Number: 6,117,208

[45] Date of Patent: Sep. 12, 2000

[54] MOLTEN SALT PROCESS FOR PRODUCING TITANIUM OR ZIRCONIUM POWDER

[76] Inventor: Ram A. Sharma, 2951 Homewood Dr., Troy, Mich. 48098

[21] Appl. No.: 09/065,817

[22] Filed: Apr. 23, 1998

[51] Int. Cl.[7] ..... C22B 34/10

[52] U.S. Cl. ..... 75/613; 75/614

[58] Field of Search ..... 75/613, 614

[56] References Cited

U.S. PATENT DOCUMENTS

| | | | |
|---|---|---|---|
| 1,088,909 | 3/1914 | Kuzel et al. | 75/614 |
| 4,680,055 | 7/1987 | Sharma | 75/610 |

FOREIGN PATENT DOCUMENTS

| | | | |
|---|---|---|---|
| 755083 | 8/1956 | United Kingdom | 75/614 |
| 795162 | 3/1958 | United Kingdom | 75/614 |
| 1342991 | 1/1974 | United Kingdom | 75/613 |

*Primary Examiner*—Melvyn Andrews
*Assistant Examiner*—Tima McGuthry-Banks
*Attorney, Agent, or Firm*—Reising, Ethington, Barnes, Kisselle, Learman & McCulloch, P.C.

[57] ABSTRACT

Titanium metal is produced using titanium dioxide as the starting material. A molten metal collection pool is first prepared in a reaction vessel from zinc and calcium. A molten salt mixture is then added to the vessel comprised of a mixture of calcium chloride and calcium fluoride. The titanium oxide starting material is then added along with additional calcium and the contents are mechanically stirred while maintaining at a temperature of about 800° C. The titanium reacts spontaneously with the calcium, producing titanium powder and calcium oxide. The titanium becomes embedded in the molten zinc pool and settles to the bottom of the vessel, where it is removed and the titanium separated from the zinc by vacuum distillation or a suitable electrochemical process. The same process applies for producing zirconium from zirconium dioxide.

8 Claims, 1 Drawing Sheet

MOLTEN SALT PROCESS FOR PRODUCING TITANIUM OR ZIRCONIUM POWDER

This invention relates generally to the production of titanium or zirconium metal and particularly to a process for producing titanium or zirconium metals using titanium or zirconium dioxide as the starting material.

BACKGROUND OF THE INVENTION

Titanium, Ti, atomic number 22, atomic mass 47.9, is a member of group 4 of the periodic table. Pure titanium is a silvery white, ductile metal, melting point (1668±50° C.), boiling point (3500° C.). α-Ti has hexagonal structure of the magnesium type. It transforms into the body-centered cubic β-phase at 882.5° C. The metal has 4.5 g/cm$^3$ density and 100–110 Gpa modulus of elasticity at 25 ° C. The standard electrode potential of the reaction $TI \Leftrightarrow T^{2+}+2e$ is −1.75 V. The corrosion resistance of titanium metal is due to the formation of a thin, dense, stable, adherent surface film of its oxide, which immediately reforms after mechanical damage if oxygen is present in the surrounding medium.

Titanium is widely distributed and is ninth in order of abundance. The most important minerals are anatase ($TiO_2$), ilmenite ($FeTiO_3$) perovskite ($CaTiO_3$), rutile ($TiO_2$), and sphene [$CaTi(SiO_4)O$].

The most important and useful mineral for the extraction of titanium and titanium compounds is rutile. Naturally occurring enriched rutile is brown to black in color, and contains 90–97% $TiO_2$. Proven world reserves of rutile and ilmenite calculated as $TiO_2$ content have been estimated at $423\times10^6$ to $600\times10^6$ tons. The largest reserves of ilmenite are in South-Africa, India, the United States, Canada, Norway, Australia, Ukraine, Russia, and Kazakhstan, and of rutile in Brazil.

Titanium metal is exclusively produced according to the current Kroll process by reduction of titanium tetrachloride, which is manufactured from natural rutile and from so-called synthetic rutile, obtained from ilmenite.

In the Kroll process, titanium tetrachloride is reduced to titanium metal by either liquid magnesium or sodium in an inert atmosphere of helium or argon at a temperature between 712 and 920° C. The following reactions possibly take place during reduction:

$$TiCl_4+2Mg \Rightarrow Ti+2MgCl_2+Mg\ excess \quad [1]$$

$$TiCl_4+4Na \Rightarrow Ti+4NaCl \quad [2]$$

The magnesium reduction is carried out in a cylindrically shaped steel vessel, often with a rounded bottom. The surface oxide of the vessel is removed before its use by filling it with hydrogen and heating to above red heat, then flushing out the hydrogen with helium or argon. The reaction vessel sizes range from small units, 3 feet high by 2.3 feet in diameter, producing 250 lbs, to large units, 9 feet high by 5 feet in diameter, producing 3000 lbs of metal.

Magnesium bars for the reduction, with 15 to 20% excess over the theoretical amount, are cleaned, pickled in hydrochloric acid, dried, and put in the reaction vessel.

A shallow dome-shaped lid with two inlet pipes is welded to the open top of the vessel. The vessel is placed in a gas or oil-fired furnace and heated to approximately 850° C. Liquid $TiCl_4$ is added at a controlled rate through one of the inlet pipes and reacts with molten magnesium to produce titanium and magnesium chloride. The reaction is exothermic and the reactor temperature is maintained between 712° C. and 920° C. by controlling the rate of $TiCl_4$ addition. The minimum lower temperature of 712° C. is the melting point of $MgCl_2$. At any lower temperature solidified magnesium chloride is reported to interfere with the reduction reaction. The maximum temperature of 920° C. is restricted because titanium forms an alloy with the steel reactor above 1000° C. and the exothermic reaction becomes too rapid and uncontrollable above 1100° C.

The temperature is maintained at about 850° C. during most of the reduction time, with the exception of the last hour, when it is raised to about 920° C. The second inlet pipe through the lid is used to maintain the pressure of the inert gas in the reactor slightly above atmosphere during the entire reduction process. A 3 feet by 2.5 feet diameter vessel which is charged with 330 lbs of magnesium and 1070 lbs of liquid $TiCl_4$ will produce 250 lbs of titanium metal over a period of 6 hours.

$TiCl_4$ reacts completely and 80–85% of the magnesium is used. Attempts to add additional $TiCl_4$ to react with the excess magnesium have not been successful, as it has been found that some of the $TiCl_4$ reacts with the titanium instead, to give titanium trichloride and titanium dichloride:

$$3TiCl_4+Ti \rightarrow 4TiCl_3 \quad [3]$$

$$2TiCl_3+Ti \rightarrow 3TiCl_2 \quad [4]$$

At the completion of the reduction, the rector is removed from the furnace and allowed to cool to room temperature, still under a small positive pressure of inert gas. The weld on the lid is then ground off, the lid removed, and the reactor tipped on its side. In this position, the cool, solidified charge is either bored out on a large lathe or chipped out with a pneumatic hammer, with the product falling into a rolls crusher where it is broken to ¼ to 1 inch size pieces. The broken mixture of titanium, magnesium chloride and excess magnesium passes through a rotary leacher where dilute hydrochloric acid dissolves the magnesium chloride and magnesium, leaving the titanium metal, which is in the form of sponge. The metal is water washed, dried and compressed into elongated briquettes. The briquettes are welded together to form an electrode which is melted in a vacuum arc-melting consumable electrode electric furnace to produce a homogeneous metal ingot.

There is another alternate method of treating the reactant products. In this method, a tap hole at the bottom of the reactor is opened twice during the reduction and once at the end to draw off most of the magnesium chloride that is being produced. The tap hole is sealed each time by localized cooling with a water jacket freezing a plug of magnesium chloride in the tap hole. The remaining reactant products are cooled to room temperature and removed as before by boring or chipping, after which they are placed in stainless steel baskets and inserted into a vacuum distillation retort, which can be evacuated to 1 mm Hg pressure by a mechanical pump. Distillation is carried out at 875 to 920° C. for 35 hours. The retort is cooled, still under vacuum, to 815° C. and then further cooled to room temperature under an inert gas. Finally, dry air is sucked through for 6 hours to remove any volatiles, giving a total treatment time of about 50 hours.

Titanium sponge is left in the basket after this treatment and is broken loose with a compressed air hammer to be briquetted and vacuum melted as before. Both the remaining magnesium chloride and excess magnesium are distilled off.

In some other instances the vacuum distillation is done directly in the retort, without removing the solidified charge, and here again the magnesium and magnesium chloride are distilled off, leaving titanium sponge to be broken out, briquetted, and vacuum melted.

The titanium metal produced by any of these methods will have a purity of about 99%, with the major impurities being magnesium, iron, chlorine, and manganese.

The reduction of titanium tetrachloride with sodium is in general very similar to that done with magnesium. Purified liquid sodium at a temperature a bit above its melting point of 97° C. is run into the argon-filled reactor and heated to 700° C. Liquid titanium tetrachloride is then dripped in at a rate to maintain the operating temperature between 850 and 900° C. This temperature range is being governed on the low side by the 801° C. melting point of sodium chloride and on the high side by the 1000° C. temperature where alloying takes place between titanium and the steel retort. At the end, the reaction vessel is sometimes first drained of the molten sodium chloride, and in other instances the whole charge is solidified before being bored or chipped out. Sodium chloride is removed from the titanium sponge by leaching in dilute hypochloric or 2% nitric acid. After this, the sponge is water washed, dried, briquetted, and melted in a vacuum to homogeneous metal.

The major difference in the magnesium and sodium processes is that while an excess of magnesium was used, a deficiency of sodium is put in the reactor along with a small excess of titanium tetrachloride. This is to avoid any excess of sodium at the end of the reaction which would be a fire hazard during the leaching procedure, when the metallic sodium could react with water and burn.

A second method of sodium reduction has accurate charges of molten sodium put into large argon-filled and sealed pots, which are then cooled and moved to the reduction area. In this area, a continuous reactor is charged with accurate amounts of $TiCl_4$ and metallic sodium, giving a mixture of titanium dichloride and sodium chloride by the reaction:

$$3TiCl_4+6Na \Rightarrow 3TiCl_2+6NaCl \quad [5]$$

This produced mixture is then run into the first sodium-charged pots. These pots are now transported to a furnace where at 850 to 900° C. the second reduction stage of titanium dichloride with sodium takes place, to produce titanium sponge and sodium chloride:

$$TiCl_2+2Na \Rightarrow Ti+2NaCl \quad [6]$$

The red-hot pots are removed from the furnace to cool after the reaction is completed. Then, as before, the solidified product is chipped out, crushed, and leached in dilute HCI to dissolve out the sodium chloride; and after water washing, the titanium sponge is dried, briquetted, and vacuum melted to solid ingot.

Both reduction processes are batch operations. They appear too inefficient time-wise. They use $TiCl_2$ which is costly and requires special care in all operations, such as transferring, storing, and even in utilization. The processes involve too many steps before the final product is produced. They involve heating and cooling cycles which make them energy-wise inefficient.

SUMMARY OF THE INVENTION

It is an object of the invention to provide a process for producing titanium in which titanium dioxide is used as the starting material, rather than $TiCl_4$, in order to simplify and lower the cost of producing titanium.

Titanium dioxide may be prepared by a straightforward and less cumbersome method than the preparation $TiCl_4$. This method may be similar to that of alumina preparation. It does not require any special precautions in handling, such as storage, transportation and utilization. Its use may simplify the titanium production and purification processes using less steps, time and space.

According to the invention, a method of producing titanium metal includes the steps of preparing a salt bath of molten calcium chloride and calcium fluoride in a reaction vessel, and adding to the vessel a quantity of titanium dioxide and calcium which react spontaneously to reduce the titanium dioxide, forming titanium metal and calcium oxide which remains in solution.

According to a further aspect of the invention, a quantity of zinc is added to the molten salt bath. Upon reduction of the titanium dioxide the titanium is encapsulated by the zinc to facilitate efficient removal of the titanium from the salt bath. To promote complete reduction, the contents of the salt bath are agitated to bring the calcium into contact with the titanium oxide in an efficient manner and, following reduction, the bath is allowed to settle whereupon the zinc and encapsulated titanium segregate to the bottom of the vessel where they can be readily siphoned off. The titanium may then be removed from the zinc by conventional distillation or electrolectic processes to obtain pure zinc.

The free energy change of the reaction:

$$TiO_2+2Ca \Rightarrow Ti+2CaO \quad [7]$$

is negative and about 15 kcal more negative than that of $TiO_2$ reduction with magnesium, over the temperatures under consideration. The negative free energy change indicates that the reaction is spontaneous. Reduction of $TiO_2$ with Ca, producing Ti of ultimate oxygen concentration 0.1–0.3% has been reported and may be carried out without facing any problem at a temperature of about 800° C. In the present case, the reduction is conducted in a molten $CaCl_2$–$CaF_2$ medium being stirred mechanically in the reactor. This has been done (1) to separate Ti from Cao; (2) to eliminate possible reaction kinetics problems; and (3) to obtain titanium metal of the highest purity.

The phase diagram of the $CaCl_2$—$CaF_2$ system indicates a large range of suitable melts for use as a medium to carry out the reaction. The standard free energies of formation of $CaCl_2$ and $CaF_2$ are far more negative than those of $TiCl_4$. Therefore $CaCl_2$—$CaF_2$ should not react with the produced Ti.

The phase diagrams of $CaCl_2$—CaO and $CaCl_2$ $CaF_2$—CaO systems show appreciable solubility of CaO in these melts at the temperatures of interest. All of the CaO produced during the reduction can be maintained in solution by having an appropriate amount of $CaCl_2$—$CaF_2$ melt to reduce any chance of interference by CaO in the reduction, and to produce Ti of desired oxygen concentration by lowering CaO activity in the melt.

It is believed that the reduction of $TiO_2$ by calcium should proceed mostly by calcium dissolved in the molten salt phase. Therefore, calcium solubility, which is appreciable in the $CaCl_2$—$CaF_2$ melts, is crucial to the kinetics of the reduction process. Calcium is preferred as a reductant over magnesium because calcium has higher solubility in molten calcium chloride, a major constituent of the salt phase, than that of magnesium in $MgCl_2$, a major constituent of the salt phase in the reduction of $TiO_2$ by magnesium.

The next step in achieving a complete separation of Ti metal from the salt phase is to extract it into a metallic pool.

This pool may be a Ca—Zn melt, the composition of which can be selected using the phase diagram of the Ca—Zn system which is molten over its entire range of compositions at approximately 800° C. Other metals that could be used instead of Zn include cadmium and aluminum, although these material are less dense than zinc and would tend not to settle as quickly and completely as zinc, and are thus less preferable.

At the start of the reduction, the pool consists of a Ca—Zn melt. However, calcium is consumed in the reduction and the Ti produced is extracted in the pool, forming a Zn—Ti melt and an intermetallic compound. The intermetallic compound probably being lighter than the Zn—Ti melt should be embedded in the upper portion of the pool below the salt phase, which is far lighter than the metallic pool. The embedded portion of the pool can be periodically siphoned off and Ti (melting point 1660° C.) can be separated from zinc (boiling point 907° C.) by vacuum distillation or a suitable electrochemical technique. Similarly, salt phase can be siphoned off and regenerated periodically according to known chlorination techniques in a separate unit. Reductant calcium can be regenerated by electrolysis of the chlorinated salt phase and the chlorine generated can be used in the chlorination of the salt phase.

The process can also be used for the production of zirconium, using zirconium dioxide in place of the titanium dioxide starting material

THE DRAWINGS

The sole drawing FIG. 1 shows a flow diagram of a titanium production process according to a presently preferred embodiment of the invention.

DETAILED DESCRIPTION

1. Materials

Figure 1:
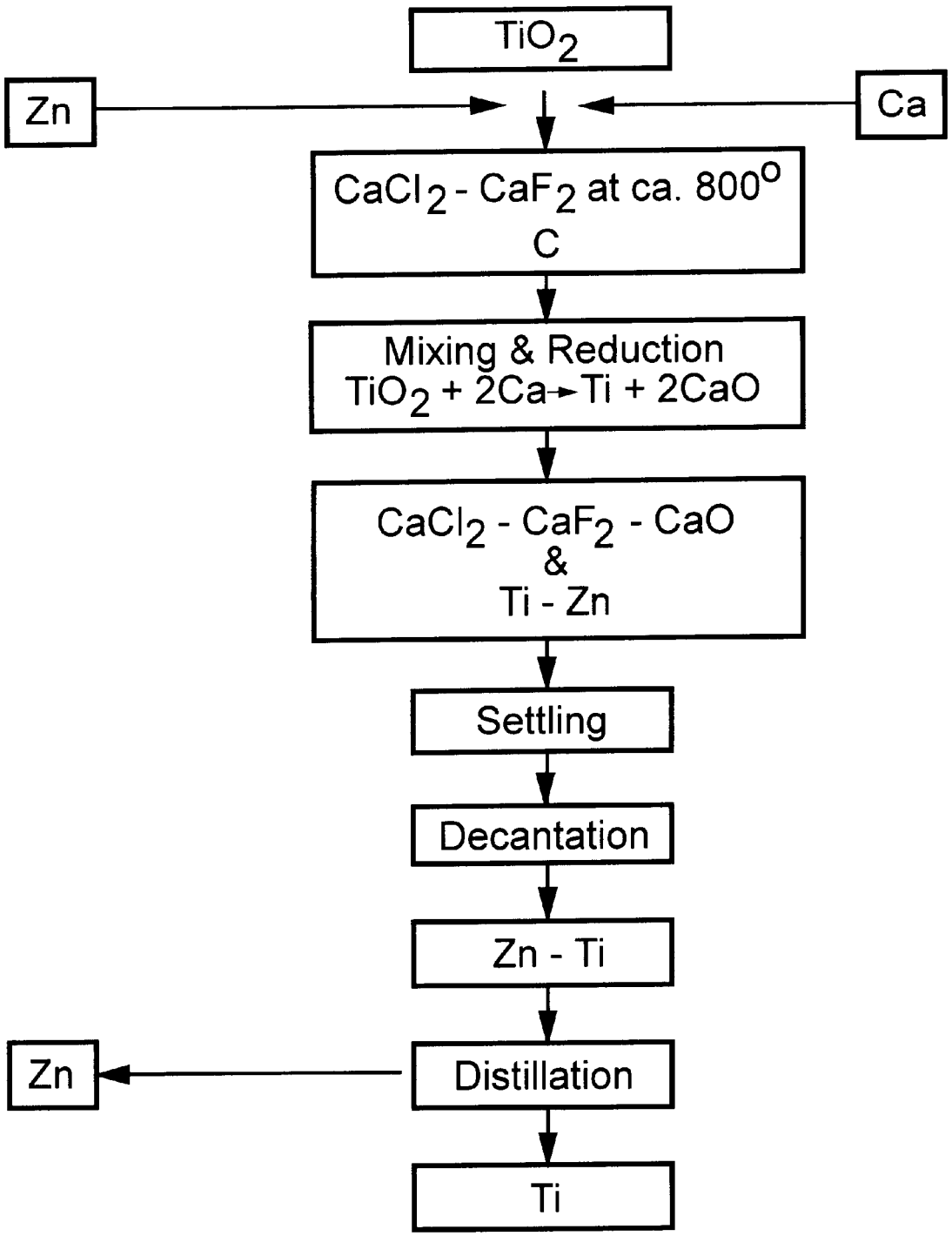

Titanium dioxide powder of highest purity available is used as the source of titanium. Before reduction, the oxide may be oven-dried for about 2 hours at 1000° C. to remove moisture and other volatiles.

Anhydrous calcium chloride of 99.9+% purity and calcium fluoride of 99.9% purity are used to prepare the various salt baths. Calcium metal granules of 99.5% purity and zinc metal sticks of 99.9+% purity are used to make the Ca—Zn extraction pool.

2. Apparatus

All experimental procedures are carried out in a helium atmosphere (typically less than 1 ppm $O_2$, $N_2$ or $H_2O$) dry box having a 12.7 cm inner diameter by 54.6 cm deep furnace well extending beneath its floor. The furnace well is heated by means of a tubular three-zone clamshell heating element furnace, with 13.3 cm inner diameter and 45.7 cm long. The sides and bottom of the furnace are surrounded with firebrick and thermal insulation. Four thermocouples are mounted strategically on the outer wall of the furnace well. One of the centrally located thermocouples is used in conjunction with a proportional band temperature controller to control the temperature of the center part of the furnace zone. The outer three thermocouples are used in conjunction with a digital temperature readout system to monitor the reaction zones temperature. The top and bottom furnace zones are heated only to maintain a constant temperature throughout the test zone. They are regulated manually by means of autotransformers.

A schematic diagram of the preferred apparatus is shown in U.S. Pat. No. 4,680,055, the disclosure of which is incorporated herein by reference. The reduction reaction is carried out in a tantalum crucible 10.2 cm O.D. by 12.7 cm deep, having a 0.15 cm thick wall. This vessel is held in a 11.4 cm O.D. by 10.3 cm deep by 0.05 cm wall stainless steel container which serves to protect the furnace well from spills and splashing of the reactants. Experiments may also be conducted in mild steel reaction vessels (10.2 cm I.D.× 17.8 cm deep×0.15 cm wall).

3. Procedure

The molten alloy pool for recovery of reduced titanium metal from the molten salt is prepared by fusing the zinc and a small amount of calcium metals together in the preweighted tantalum reaction vessel. Predetermined weights of the metals are placed in the cup, and the entire reaction vessel assembly is lowered into the furnace well which is preheated to 825 K. The furnace temperature is raised to 1075 K after the zinc and calcium metals have melted and diffused into each other to make a homogenized melt. At this time the preweighted salt components are added into the cup, and the furnace temperature is reduced to the normal range for reduction (800–850° C.).

A preweighted amount of $TiO_2$ reactant is added slowly into the molten salt bath. The stirrer is immersed and used to enhance mixing of the oxide into the melt. The remaining amount of the predetermined weight of the reductant calcium is added to the melt at a controlled rate to maintain the reactor temperature within the desired range (i.e., about 800° C.–900° C.). With baffle-splash guard assembly in place, the salt bath and its contents are stirred for an assigned time interval and then slowly stirred for an additional period of time. This is done to improve the mass transfer of the reactants, and to get good separation of the metallic phase from the salt phase.

After stirring, the stirrer blade is carefully removed from the melt, and the reaction vessel pulled from the furnace well and quenched. The cool vessel is sealed in double plastic bags, removed from the dry box and radiographs are taken. A complete reaction should be indicated in the pictures by a clear, sharp interface between the salt and metal pool, and an increase in pool depth. The salts are washed out of the cup with warm running water. The wash water is filtered (150 mesh screen) to recover any metallic nodules which are not extracted by the alloy pool. After oven drying, the cup and alloy products plus the metallic nodules are weighed and the recovered titanium is determined by the difference in weights.

Core samples of the alloy product are tested for chemical analysis. The pool yield is obtained from the weight gain of the metallic pool divided by the theoretical amount of Ti available from the oxide, while the total yield includes the weight of the metallic nodules.

The flow diagram of the process is shown in FIG. 1. $TiO_2$ is added at a suitable rate and stirred into the Zn—Ca and $CaCl_2$—$CaF_2$ melts of appropriate compositions and amounts at about 800° C. The remainder of the predetermined calcium amount is added at a controlled rate to maintain the reactor temperature within desired limits. Reduction is carried out for a prescribed period of time. During the reduction, $TiO_2$ is reduced by Ca, forming Ti and CaO. In the process, calcium is totally consumed, the produced Ti is extracted in the pool, and the CaO formed is dissolved in the salt phase. After settling and decantation, a part of the pool containing Ti can be siphoned off and Ti can be recovered by vacuum distillation or a suitable electrolytic technique. The distilled zinc can be reused in the process. Similarly, a portion of the salt melt can be siphoned off periodically, chlorinated and used in the commercially available electrolytic cell for producing Ca and $Cl_2$. Calcium can be reused in the Ti production process and the chlorine generated can be used in the chlorination of the salt melt. It is thus a closed loop process.

According to another embodiment of the invention, the same process can also be used for the production of zirconium, using zirconium oxide ($ZrO_2$) in place of $TiO_2$.

The disclosed embodiments are representative of presently preferred forms of the invention, but are intended to be illustrative rather than definitive thereof. The invention is defined in the claims.

I claim:

1. A method of producing titanium metal comprising:

providing in a reaction vessel a molten alloy collection pool of molten calcium fused with a collection metal selected from the group consisting of zinc, cadmium and aluminum;

adding to the reaction vessel in combination with the molten alloy collection pool a molten salt bath of calcium chloride and calcium fluoride to provide a molten medium of the alloy collection pool and salt bath constituents;

adding to the molten medium a quantity of titanium dioxide and calcium;

mechanically stirring the molten medium to bring the titanium dioxide into contact with the calcium to thereby spontaneously reduce the titanium dioxide and calcium to titanium metal and calcium oxide which remains in solution;

continuing the stirring to bring the reduced titanium metal into contact with the collection metal of the metal alloy collection pool to thereby encapsulate the titanium metal with the collection metal;

discontinuing the stirring and allowing the encapsulated titanium and collection metals to settle together in the molten medium to the bottom of the reaction vessel; and drawing off the settled titanium and collection metals from the molten medium and separating the titanium from the collection metal to yield substantially pure titanium metal.

2. The method of claim 1 including maintaining the molten medium at a temperature of about 800–900° C.

3. The method of claim 1 wherein the collection metal consists of zinc.

4. The method of claim 1 wherein the calcium of the molten alloy collection pool is reacted with the titanium dioxide and is consumed during the reduction of the titanium dioxide.

5. A method of producing zirconium metal comprising:

providing in a reaction vessel a molten alloy collection pool of molten calcium fused with a collection metal selected from the group consisting of zinc, cadmium and aluminum;

adding to the reaction vessel in combination with the molten alloy collection pool a molten salt bath of calcium chloride and calcium fluoride to provide a molten medium of the alloy collection pool and salt bath constituents;

adding to the molten medium a quantity of zirconium dioxide and calcium;

mechanically stirring the molten medium to bring the zirconium dioxide into contact with the calcium to thereby spontaneously reduce the zirconium dioxide and calcium to zirconium metal and calcium oxide which remains in solution;

continuing the stirring to bring the reduced zirconium metal into contact with the collection metal of the metal alloy collection pool to thereby encapsulate the zirconium metal with the collection metal;

discontinuing the stirring and allowing the encapsulated zirconium and collection metals to settle together in the molten medium to the bottom of the reaction vessel; and drawing off the settled zirconium and collection metals from the molten medium and separating the zirconium from the collection metal to yield substantially pure zirconium metal.

6. The method of claim 5 including maintaining the molten medium at a temperature of about 800–900° C.

7. The method of claim 5 wherein the collection metal consists of zinc.

8. The method of claim 5 wherein the calcium of the molten alloy collection pool is reacted with the zirconium dioxide and is consumed during the reduction of the zirconium dioxide.

* * * * *

UNITED STATES PATENT AND TRADEMARK OFFICE

CERTIFICATE OF CORRECTION

PATENT NO. : 6,117,208
DATED : September 12, 2000
INVENTOR(S) : Ram A. Sharma

It is certified that error appears in the above-identified patent and that said Letters Patent is hereby corrected as shown below:

Title page,
Item [54] Title, change "MOLTEN SALT PROCESS FOR PRODUCING TITANIUM OR ZIRCONIUM POWDER" to -- METHOD OF PRODUCING TITANIUM OR ZIRCONIUM METAL --.

Signed and Sealed this

Eighth Day of January, 2002

*Attest:*

*Attesting Officer*

JAMES E. ROGAN
*Director of the United States Patent and Trademark Office*